US006856090B2

(12) United States Patent
Weyhrauch

(10) Patent No.: US 6,856,090 B2
(45) Date of Patent: Feb. 15, 2005

(54) INCANDESCENT HALOGEN LAMP HAVING FLATTENED FILAMENT SUPPORT LEADS

(75) Inventor: Ernest C. Weyhrauch, Cookeville, TN (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 348 days.

(21) Appl. No.: 10/001,406

(22) Filed: Oct. 23, 2001

(65) Prior Publication Data

US 2003/0184223 A1 Oct. 2, 2003

(51) Int. Cl.[7] ..... H01K 1/15
(52) U.S. Cl. ..... 313/578; 313/271; 313/272
(58) Field of Search ..... 313/578, 569, 313/271–274, 113, 567, 574; 445/50, 51, 24, 25

(56) References Cited

U.S. PATENT DOCUMENTS

| | | | | |
|---|---|---|---|---|
| 3,904,908 A | * | 9/1975 | Wolfe et al. | 313/271 |
| 4,302,698 A | | 11/1981 | Kiesel et al. | 313/222 |
| 4,492,893 A | | 1/1985 | Steiner et al. | 313/318 |
| 4,801,845 A | | 1/1989 | Kiesel | 313/579 |
| 5,313,135 A | | 5/1994 | Fletcher | 313/318 |
| 5,856,723 A | | 1/1999 | Rittner | 313/117 |
| 5,857,764 A | | 1/1999 | Tabata et al. | 362/214 |
| 5,949,181 A | | 9/1999 | Tabata et al. | 313/271 |
| 6,093,999 A | | 7/2000 | English et al. | 313/110 |

* cited by examiner

*Primary Examiner*—Vip Patel
*Assistant Examiner*—Joseph Williams
(74) *Attorney, Agent, or Firm*—Reising, Ethington, Barnes, Kisselle, P.C.

(57) ABSTRACT

An incandescent halogen lamp used in connection with a vehicle headlamp system in which stray light attributable to reflection off of internal lamp components is reduced while the structural integrity of the lamp is maintained. The halogen lamp includes two filaments, several lead wires, and a support bridge all sealed within a glass envelope. Each filament is connected at its outermost end to a flattened end portion of a lead wire which extends along the length of the filament from near the support bridge to the upper end of the filament. The flattened outer ends of the lead wires have a narrow profile that is in alignment with the direction of illumination of light from their respective filaments. This arrangement reduces the surface area that could otherwise interfere with light emitted by the filaments, and thereby reduces the overall stray light produced by the lamp. The flattened outer ends can have a roughened surface to further help reduce the amount of light reflected off the lead wires.

16 Claims, 3 Drawing Sheets

INCANDESCENT HALOGEN LAMP HAVING FLATTENED FILAMENT SUPPORT LEADS

FIELD OF THE INVENTION

The present invention relates generally to incandescent halogen lamp assemblies, and more particularly to incandescent halogen lamp assemblies used in vehicle headlamp systems that are designed to reduce glare attributable to reflection from interior lamp components.

BACKGROUND OF THE INVENTION

Vehicle headlamp systems have experienced many adaptations over the years, including the use of incandescent halogen lamps which result in increased light output and lower energy consumption. Unlike traditional incandescent lamps, where a filament is surrounded by an inert gas such as argon (Ar), incandescent halogen lamps envelop the filament with a gas composition that includes a gas from the halogen group. In both designs, the filament, generally tungsten (W), is supported by and connected to electric current carrying lead wires which supply the filament with current and cause it to become a glowing "white hot" according to a process commonly known as incandescence. A consequence of the incandescence process is that the filament is heated to extreme temperatures and begins to evaporate such that tungsten atoms are released into the surrounding volume. In traditional incandescent lamps, the released tungsten atoms are deposited onto a large glass bulb surrounding the filament, thereby darkening the bulb and weakening the filament. Unique to incandescent halogen lamps is the ability for the evaporated atoms to combine with the surrounding halogen gas and subsequently redeposit themselves back onto the filament, a process sometimes referred to as the halogen cycle. In this process, when the evaporated tungsten atoms are in the vicinity of a surrounding quartz envelope, they are somewhat cooled and combine with the halogen gas to form a tungsten halide molecule. This molecule then migrates back to the vicinity of the heated filament, which decomposes the molecule such that the tungsten is deposited back onto the filament and the halogen gas is released into the surrounding volume. Thus, the incandescent halogen lamp undergoes a type of recycling process, thereby increasing the life of the lamp. Moreover, the incandescent halogen lamp can be operated at a hotter temperature, thereby increasing the light emission per unit of energy. While incandescent halogen lamps improve many of the characteristics of vehicle headlamp systems, there still remains much room for further improvement.

For instance, a portion of the total light emitted from incandescent halogen lamps often reflects off of interior components of the lamp, such as the lead wires, and results in uncontrolled stray light appearing as glare to oncoming drivers. U.S. Pat. No. 4,302,698 issued Nov. 24, 1981 to Kiesel et al. discloses an incandescent halogen lamp for use in a vehicle headlamp assembly. The embodiment shown in FIG. 3*b* discloses two filaments that are supported by three current carrying lead wires. Two of the lead wires connect to the filaments at their lower most ends; and therefore do not significantly interfere with light emitted from the filaments. The third lead wire, however, connects with both filaments at their uppermost ends and consequently extends alongside the filaments. Halogen lamp assemblies having lead wires generally positioned alongside of the filaments have the potential to reflect stray light off of the lead wires which appears as glare to oncoming drivers. Thus, it would be advantageous to design an incandescent halogen lamp assembly where the lead wires do not significantly interfere with the light emitted from the filaments.

Addressing this concern, some designs have incorporated filaments having long leg portions and short lead wires, as will be subsequently discussed. In these designs, the filament has a long, thin leg portion that extends from its uppermost end and bends downward at approximately a 90° angle. The thin leg portion extends alongside the filament until it connects with a thicker lead wire proximate the lowermost end of the filament. Because the filament leg is substantially thinner than the shortened lead wire, it does not interfere with the light emission to the extent that a thicker lead wire running alongside the filament would. Accordingly, designs of this nature realize the benefits of utilizing an incandescent halogen lamp and reduce the amount of stray light, and hence glare, attributable to reflection off of internal lamp components. While these designs can improve the illumination performance of the lamp assembly, they can also compromise its structural integrity. The thin filament leg portion is weaker than the substantially thicker and stronger lead wires previously discussed. Consequently, these designs may have difficulty satisfying testing requirements, particularly vibrational testing.

Thus, it would be advantageous to provide an incandescent halogen lamp design that reduces glare due to reflection from interior lamp components, such as lead wires, but does not compromise the structural integrity of the lamp.

SUMMARY OF THE INVENTION

The above-noted shortcomings of prior art incandescent lamps are overcome by the present invention, which in one aspect comprises an incandescent lamp having a filament capable of emitting light, a lead wire, and an envelope. The lead wire supports the filament and at least partially forms an electrical network capable of supplying the filament with electric current. The envelope surrounds the filament and at least a portion of the lead wire. The lead wire has a flattened outer end that includes a narrow profile and a wide profile, with the flattened outer end being oriented such that the narrow profile is aligned with the direction of illumination of light emitted by the filament. This provides the advantages of providing good mechanical support for the filament while helping minimize the amount of undesirable light reflection off the support lead.

Preferably, the incandescent lamp is a halogen vehicle headlamp, and can include a second filament also supported by a lead wire having a flattened outer end, with the two filaments being connected at their other end to a third, common ground lead wire. The lamp can also be part of a complete vehicle headlamp system that includes the lamp, a reflector, and a front lens.

In accordance with another aspect of the present invention, there is provided a method for of forming the incandescent lamp. The method includes the steps of forming a first lead wire by flattening an end portion of a section of electrically-conductive wire, providing a second lead wire formed from a section of electrically-conductive wire, attaching a filament between the second lead wire and the flattened end portion of the first lead wire, and sealing the filament and at least a portion of the first and second lead wires within a glass envelope. During the assembly of these components together, the flattened end portion is oriented such that the it lies within a plane that intersects the filament. Preferably, the end portion is flattened by stamping and this stamping operation can also be used to simultaneously impart a roughened surface texture to the end portion to further reduce the amount of light reflected off the end portion. Other surface treatments such as coating can be used as well to provide a roughened surface on the flattened end portion.

DETAILED DESCRIPTION OF THE PREFERRED EMBODIMENT

Figure 1A:
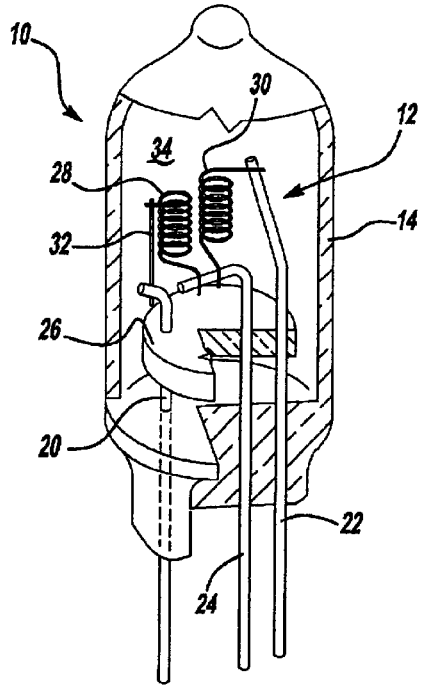
Fig-1A PRIOR ART
FIG. 1A is a perspective and partial sectional view of a prior art incandescent halogen lamp assembly.
Figure 1B:
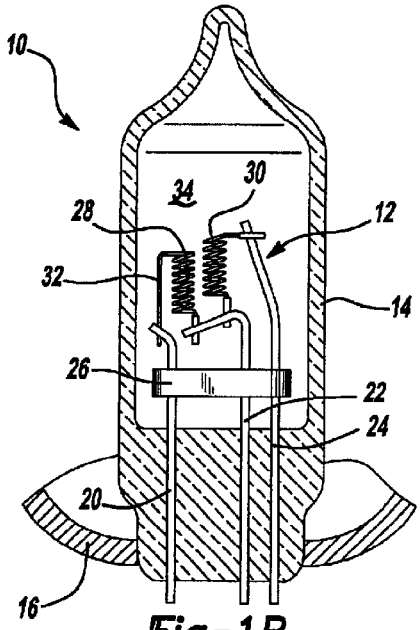
Fig-1B PRIOR ART
FIG. 1B is a cross-sectional view of a prior art incandescent halogen lamp assembly.

Referring to FIGS. 1A–B, there is shown a prior art incandescent halogen lamp 10 that generally includes interior components 12 and an envelope 14, and is surrounded by a parabolic reflector 16. The interior components are responsible for illumination, and are further comprised of several filament support lead wires 20, 22, and 24 that pass through a disk-like support bridge 26 and supply electric current to a high beam filament 28 and a low beam filament 30. High beam filament 28 further includes a thin leg portion 32, which extends outwardly from the filament and is bent downwards such that it continues alongside the filament until it connects with lead wire 20 at an axial position below filament 28. Envelope 14 is typically made of high temperature materials such as quartz or other suitable glass, and surrounds the interior components such that a sealed environment 34 is formed. This environment commonly consists of a combination of halogen and inert gases and is essential to the regenerative halogen cycle, as previously explained. Reflector 16 has a generally parabolic cross-sectional shape, and is mounted to lamp 10 such that low beam filament 30 is positioned in relation to a focal point of the reflector.

In operation, the prior art incandescent halogen lamp 10 emits visible light by selectively supplying electric current through the lead wires such that one of the two filaments are energized. This energization causes the filament to emit light which exits envelope 14 and is focused in front of the vehicle by reflector 16. As previously mentioned, it is desirable to create an incandescent halogen lamp that reduces glare caused by reflection off of internal components. Moreover, it has been found that a significant portion of the internal component glare is attributable to reflection off of the lead wires. Thus, the prior art lamp assembly seen in FIGS. 1A-B utilizes thin leg portion 32 to connect lead wire 20 to filament 28. By using a thin leg portion instead of extending the substantially thicker lead wire 20 up alongside the filament, there is less surface area from which the light emitted by the filament can reflect. Consequently, the amount of stray light due to reflection from internal components is reduced. This reduction in glare, however, is offset by diminishing the structural integrity of the lamp since there is less material in the leg portion for structural strength than would otherwise be provided by a standard lead wire. Accordingly, designs employing thinner connections between the lead wires and filaments, such as that seen in FIGS. 1A–B, may have difficulty passing testing directed to structural integrity, such as vibrational testing.

Figure 2A:
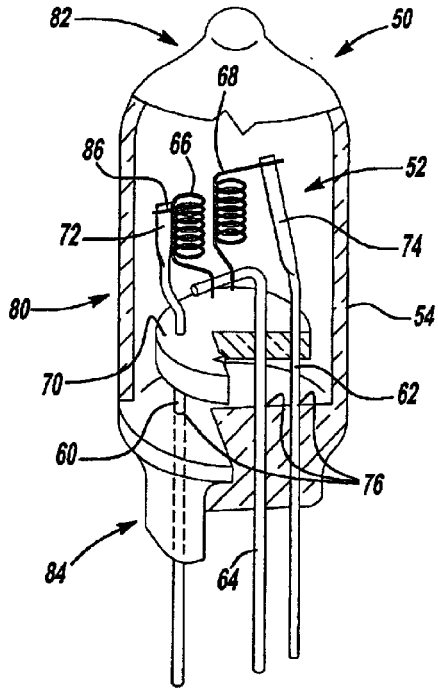
FIG. 2A is a perspective and partial sectional view of the incandescent halogen lamp assembly of the present invention.
Figure 2B:
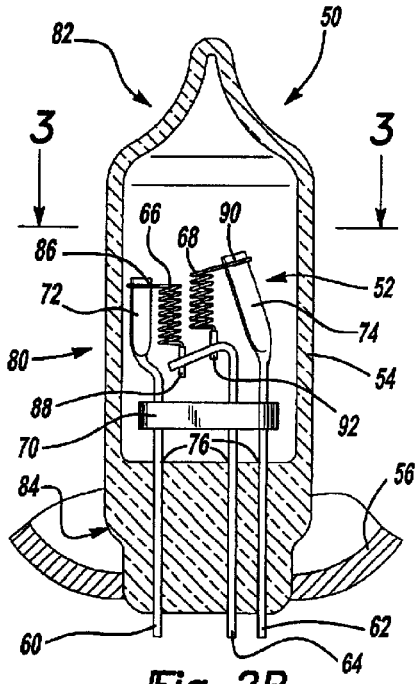
FIG. 2B is a cross-sectional view of the incandescent halogen lamp assembly of the present invention.
Figure 4:
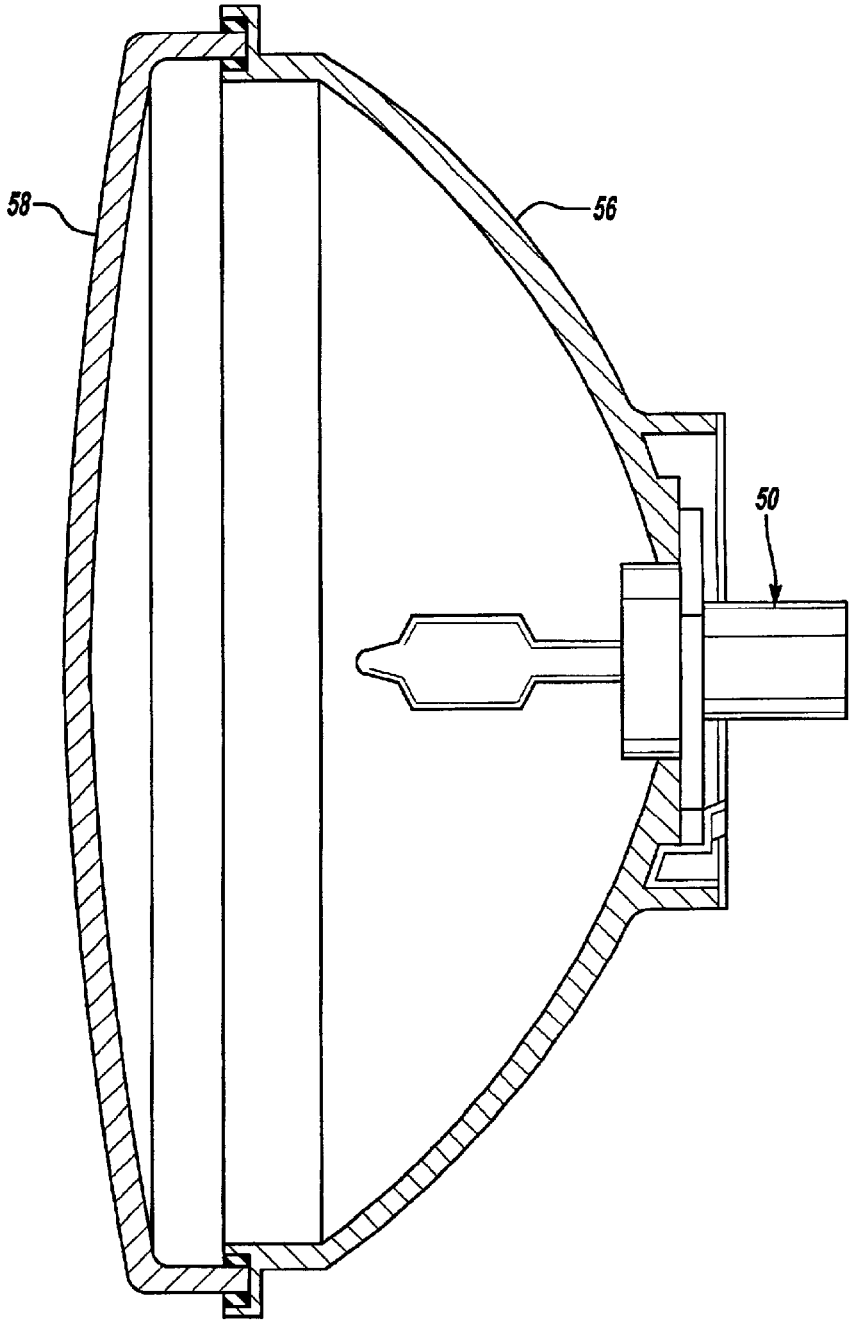
FIG. 4 is a diagrammatic view showing a vehicle headlamp system using the incandescent lamp of FIG. 2A.

Referring now to FIGS. 2A–B, there is shown a portion of a vehicle headlamp assembly, or system, that includes the incandescent halogen lamp 50 of the present invention. As with the prior art lamp previously described, lamp 50 includes interior components 52 and envelope 54. The interior components of the lamp emit light through the process of incandescence and are generally comprised of three lead wires, two filaments, and a support bridge. Envelope 54 is composed of a high temperature, transparent material and creates a sealed environment around the interior components. As shown in FIG. 4, the headlamp system also includes a reflector 56 and front lens 58. The reflector 56 is an optically reflective component shaped and positioned with respect to the lamp such that it reflects light emitted by the filaments according to a predetermined pattern that is emitted by the headlamp assembly through the front lens 58. In operation, the vehicle headlamp system supplies electric current to a specific lead wire, thereby selectively illuminating one of the two filaments. The visible light emitted from this filament is transmitted out of the envelope where it strikes the reflector and is redirected through the lens and onto the road. As will be appreciated by those skilled in the art, the lamp 50 can be incorporated into a sealed beam headlamp or as a replaceable lamp for any halogen inner burners with one or more axially oriented filaments such as, for example, 9005, 9006, 9007, and 9008 type headlamps.

Figure 3:
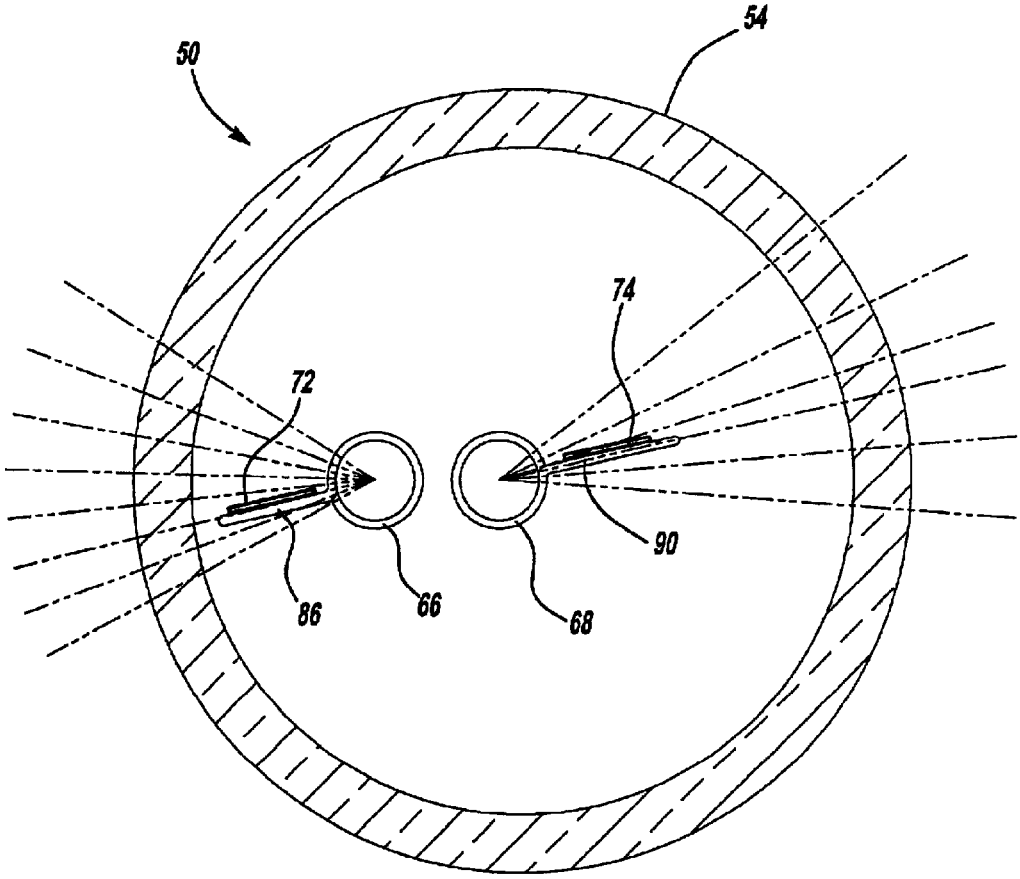
FIG. 3 is a top-down view of the incandescent halogen lamp assembly of the present invention taken along line 3 of FIG. 2B.

Interior components 52 are similar to those commonly found in most incandescent halogen lamps and generally include positive lead wires 60 and 62, ground wire 64, high beam filament 66, low beam filament 68, and support bridge 70. Lead wires 60 and 62 are part of an electrical network of the vehicle headlamp system and act as positive terminals to filaments 66 and 68, respectively. Ground wire 64 is also part of the electrical network and functions as a common ground for the two filaments. Each of these three wires passes through support bridge 70, which is a disk-shaped component comprised of a high temperature material similar in nature to the envelope, and acts as a spacer and support for the wires. At the uppermost end of each of the positive lead wires 60 and 62, there is a flattened outer end section 72 and 74, respectively. These sections are formed by a flattening tool that, prior to assembly of the lamp, is used in a stamping operation to deform the end portion of the positive lead wires into a flattened shape. The surface of the flattening tool can have a textured surface so that this stamping operation can be used to simultaneously flatten the end portion and impart a roughened surface to that end portion. It is envisioned that this flattening tool could impart other non-reflective surface features onto the flattened outer ends at the time of flattening, and that the flattened outer ends can be provided with a roughened surface treatment in other ways, such as non-reflective coatings, etc. Thus, positive lead wires 60 and 62 begin as uniform lengths of wire, but are later flattened at an outer end such that the flattened sections have a narrow profile in a first direction, and a wide profile in a second direction. The views seen in FIGS. 2A–B illustrate the wide profiles of flattened sections 72, 74, while the top down view of FIG. 3 shows the narrow profiles of the flattened outer ends. As will be further explained, flattened end 72 is oriented such that its narrow profile is aligned with the direction of illumination of filament 66, thereby exposing the least amount of surface area to interfere with light emitted by the filament. Similarly, the narrow profile of flattened end 74 is in alignment with the direction of illumination of filament 68. As best seen in FIG. 3, the flattened end portions of the lead wires are thus oriented such that they lie within a plane that intersects their respective filaments. By flattening the lead wires and orienting them in this manner, the amount of surface area that could potentially interfere with light emitted from the filaments has been substantially reduced. As mentioned above, to further minimize reflection off the lead wires, the wide profiles of flattened sections 72 and 74 have roughened, non-reflective surfaces which do not reflect the small amount of light which impinges upon these surfaces.

As indicated in the drawings, only a portion (such as the end portion) of the positive lead wires 60 and 62 are flattened, such that these lead wires have both a flattened portion and a non-flattened portion. The flattened portion of each lead wire 60, 62 runs alongside its associated filament with the non-flattened portions being located below the filaments where they cause little if any undesirable reflection of light coming from the filaments. The lead wires 60, 62, and 64 have a generally circular cross-sectional shape. Also, as indicated in FIG. 3, the degree of flattening of the end portions is such that the width of the non-flattened portion is greater than that of the narrow profile of the flattened end portion, but less than that of the wide profile.

It should also be noted that the mass of flattened outer ends 72, 74 has not been reduced, unlike the thin leg portion 32 seen in FIGS. 1A–B. Therefore, the strength of sections 72 and 74 is not significantly impaired. This attribute is of particular advantage considering the lead wires are responsible for not only supplying the filaments with electric current, but also physically supporting them in place. Support bridge 70 is composed of a high temperature material and is designed to space and support wires 60, 62, and 64 via several holes 76. The support bridge may float within the sealed environment 34 or may be attached to the envelope.

Filaments 66 and 68 are helical, spring-like tungsten filaments that are supported by lead wires 60 and 62, respectively, and are capable of emitting visible light when energized with sufficient electric current. Best seen in FIG. 2B, high beam filament 66 has upper and lower leg portions 86, 88 which are used to attach the filament to flattened outer section 72 and ground wire 64, respectively. This attachment can be accomplished by welding the components together, utilizing a clamped hook type fastener, or employing other techniques commonly known in the art. Likewise, low beam filament 68 has an upper leg section 90 which is secured to flattened outer section 74 and a lower leg section 92 secured to the ground wire.

Envelope 54 is comprised of a high temperature, transparent material and generally includes a main body portion 80, a non-transparent tip portion 82, and a base portion 84. The main body portion is generally cylindrical in shape and axially extends from base portion 84 to tip portion 82. This portion of the envelope is transparent, as light is intended to radially exit the main body portion, strike the reflector, and be redirected in front of the vehicle. In order to reduce stray light that could otherwise be transmitted out of the tip of the envelope, tip portion 82 has a non-transparent, or even reflective, coating applied to it. Therefore, the high majority of light emitted by the filaments must pass through the transparent main body portion 80 and be focused by reflector 56, a process that produces more precise and focused illumination patterns than emitting light directly out of tip portion 82. Base 84 may take on one of any number of shapes necessary to accommodate attachment to the reflector or another headlamp system component, as is commonly known in the art.

Reflector 56 is part of the greater vehicle headlamp system and is generally a reflective parabolic component having a focal point corresponding to the position of one of the filaments, preferably low beam filament 68. By positioning the low beam filament with respect to the focal point of the reflector, it is possible for the reflector to focus and redirect the impinging light rays such that they leave the reflector in an essentially parallel orientation. This reduces spreading of the illumination pattern and thereby decreases the amount of glare seen by oncoming drivers.

Operation of the present invention is best described in conjunction with the top down view of the present invention shown in FIG. 3. In use, the vehicle headlamp system selectively applies electric current to one of the two positive lead wires 60, 62 (not shown) depending on whether the high or low beams have been selected. If the high beams are chosen, electric current is supplied through lead wire 60, flattened outer end Section 72, filament 66, and ground wire 64. The current through the filament energizes the filament such that it emits visible light, as demonstrated by the light rays shown in FIG. 3. Similarly, if the low beams have been engaged, the headlamp system will send a current through lead wire 62, flattened outer end section 74, filament 68, and ground wire 64, thereby causing the filament to emit visible light. As light emanates from the filament, it radially exits the transparent main body portion 80 of the envelope and strikes reflector 56. Thus, the light rays leave the reflector in a generally parallel manner, thereby creating a tight illumination pattern and minimizing glare producing stray light.

As previously mentioned, a significant portion of the stray light commonly produced by incandescent halogen lamps is attributable to reflection off of internal components, such as the lead wires. In response to this undesirable reflection, the otherwise thick lead wires of the present invention have been flattened such that there is little obstructing surface area to interfere with light emanating from the filaments. Again referring to FIG. 3, the narrow profile of flattened outer end 72 is aligned with the direction of illumination radiating from filament 66. Accordingly, a significant portion of the light produced by filament 66 passes by the flattened lead unobstructed, and continues out of envelope 54 where it eventually strikes the reflector. In a similar fashion, flattened outer end section 74 is aligned with the direction of illumination of filament 68, thereby supporting the filament and supplying it with electric current, but doing so in a minimally obstructive manner. While some portion of the total light emitted by the filaments may scatter off of the narrow profiles of the flattened end sections, this stray light is held to a minimum. Furthermore, the amount of material comprising the flattened sections has not been reduced, rather it has been reshaped. The strength of the flattened lead wire sections 72 and 74 is substantially greater than a section, such as thin leg section 32 seen in FIGS. 1A–B, where the overall mass of the component has been significantly reduced. Consequently, the incandescent halogen lamp of the present invention reduces glare due to reflection from internal lamp components without compromising its structural integrity.

It will thus be apparent that there has been provided in accordance with the present invention an incandescent halogen lamp which achieves the aims and advantages specified herein. It will, of course, be understood that that foregoing description is of a preferred exemplary embodiment of the invention and that the invention is not limited to the specific embodiment shown. Various changes and modifications will become apparent to those skilled in the art and all such changes and modifications are intended to be within the scope of the present invention.

I claim:

1. An incandescent lamp, comprising:

a filament capable of emitting light, a lead wire supporting said filament and capable of supplying electrical current to said filament, said lead wire having a generally circular cross-sectional shape with a flattened outer end, and an envelope surrounding said filament and at least a portion of said lead wire that includes said flattened outer end, wherein said flattened outer end includes a narrow profile and a wide profile and is oriented such that said narrow profile is aligned with the direction of illumination of light omitted by said filament.

2. The incandescent lamp of claim 1, wherein said lamp is a vehicle headlamp.

3. The incandescent lamp of claim 1, wherein said lamp is an incandescent halogen lamp.

4. An incandescent lamp, comprising;

a filament capable of emitting light, a lead wire supporting said filament and at least partially foaming an electrical network capable of supplying electrical current to said filament, said lead wire having a flattened outer end, and an envelope surrounding said filament and at least a portion of said lead wire that includes said flattened outer end, wherein said flattened outer end includes a narrow profile and a wide profile and is oriented such that said narrow profile is aligned with the direction of illumination of light emitted by said filament, wherein said wide profile of said flattened outer end has a surface including a non-reflective surface feature.

5. The incandescent lamp of claim 4, wherein said non-reflective surface feature is a roughened surface.

6. The incandescent lamp of claim 1, wherein said lead wire comprises a first lead wire and further comprising a second lead wire at least partially located within said envelope, wherein said filament has a first end connected to said flattened outer end of said first lead wire and said filament has a second end connected to said second lead wire.

7. The incandescent lamp of claim 6, further comprising a second filament and a third lead wire, with said filament and at least a portion of said third lead wire being located within said envelope, said third lead wire having a flattened outer end that includes a narrow profile aligned with the direction of light emitted by said second filament, wherein said second filament has a first end connected to said flattened outer end of said third lead wire and a second end connected to said second lead wire.

8. An incandescent halogen lamp for use with a vehicle headlamp system, comprising:

a first filament capable of emitting light and having a first and second end, a second filament capable of emitting light and having a third and fourth end, a first lead wire supporting said first filament and capable of supplying electric current to said first filament, said first lead wire having a generally circular cross-sectional shape with a flattened outer end connected to said first end, a second lead wire supporting said second filament and capable of supplying electric current to said second filament, said second lead wire having a generally circular cross-sectional shape with a flattened outer end connected to said third end, a ground wire capable of supplying electric current to said first and second filaments and having an outer end connected to said second and fourth ends, and a lamp envelope containing a halogen gas, wherein said first and second filaments, said flattened outer ends of said first and second lead wires, and said outer end of said ground wire are all scaled within said envelope, and wherein said flattened outer ends each comprise a narrow profile and a wide profile and each of said flattened outer ends is oriented such that said narrow profiles are aligned with the direction of illumination of light emitted by the filament to which they arc attached.

9. A vehicle headlamp system for providing illumination, comprising:

an incandescent lamp that includes:

a filament capable of emitting light, a lead wire electrically and mechanically connected to said filament to thereby support said filament and supply electric current to said filament, said lead wire having a generally circular cross-sectional shape with a flattened outer end, and an envelope surrounding said filament and at least a portion of said lead wire that includes said flattened outer end.

wherein said flattened outer end includes a narrow profile and a wide profile and is oriented such that said narrow profile is aligned with the direction of illumination of light emitted by said filament, a reflector partially surrounding said envelope, and a front lens, with said incandescent lamp being located between said lens and reflector such that a portion of the light emitted tram said lamp is redirected by said reflector to exit said headlamp system through said lens.

10. The vehicle headlamp system of claim 9, wherein said incandescent lamp is a halogen lamp.

11. An incandescent lamp, comprising:

a scaled lamp envelope, first and second lead wires extending into said envelope, a filament attached to said first and second lead wires inside said envelope, wherein at least one of said lead wires has a flattened portion that runs alongside said filament and a non-flattened portion located below said filament, said flattened portion having a narrow profile and a wide profile with said non-flattened portion having a width greater than said narrow profile but less than said wide profile, and wherein said flattened portion is oriented such that said narrow profile is aligned with the direction of illumination of light emitted by said filament.

12. An incandescent lamp as defined in claim 11, wherein said flattened portion comprises a flattened end portion of said first lead wire.

13. An incandescent lamp as defined in claim 11, wherein the said flattened portion has a non-reflective surface.

14. An incandescent lamp as defined in claim 11, further comprising a second filament and a third lead wire, said third lead wire having flattened and non-flattened portions with its flattened portion extending alongside said second filament and said second filament being attached to said second and third lead wires.

15. A vehicle headlamp system for providing illumination, comprising:

an incandescent lamp that includes:

a sealed lamp envelope, first and second lead wires extending into said envelope, and a filament attached to said first and second lead wires inside said envelope, a reflector partially surrounding said envelope, and a front lens, with said incandescent lamp being located between said lens and reflector such that a portion of the light emitted from said lamp is redirected by said reflector to exit said headlamp system through said lens, wherein at least one of said lead wires has a flattened portion that runs alongside said filament and a non-flattened portion located below said filament, said flattened portion having a narrow profile and a wide profile with said non-flattened portion having a width greater than said narrow profile but less than said wide profile, and wherein sad flattened portion is oriented such that said narrow profile is aligned with the direction of illumination of light emitted by said filament.

16. The vehicle headlamp system of claim 15, wherein said incandescent lamp is a halogen lamp.

* * * * *

UNITED STATES PATENT AND TRADEMARK OFFICE

CERTIFICATE OF CORRECTION

PATENT NO. : 6,856,090 B2
DATED : February 15, 2005
INVENTOR(S) : Ernest C. Weyhrauch It is certified that error appears in the above-identified patent and that said Letters Patent is hereby corrected as shown below:

Column 7,
Line 27, replace “foaming” with -- forming --

Column 8,
Line 12, replace “scaled” with -- sealed --
Line 37, replace “tram” with -- from --
Line 43, replace “scaled”with -- sealed --

Column 10,
Line 8, replace “sad” with -- said --

Signed and Sealed this

Thirty-first Day of May, 2005

JON W. DUDAS
*Director of the United States Patent and Trademark Office*